United States Patent [19]

Myotte

[11] Patent Number: 4,676,465

[45] Date of Patent: Jun. 30, 1987

[54] TOOL ACCESSORY

[76] Inventor: Albert J. Myotte, 1457 Guerneville Rd., Santa Rosa, Calif. 95401

[21] Appl. No.: 690,776

[22] Filed: Jan. 11, 1985

[51] Int. Cl.[4] ..... A47G 29/00

[52] U.S. Cl. ..... 248/126; 248/316.7; 248/340; 24/346; 24/545; 362/396

[58] Field of Search ..... 362/396, 427, 429, 430; 24/344, 346, 343, 545, 556, 563; 248/304, 316.5, 305, 126, 316.7, 340

[56] References Cited

U.S. PATENT DOCUMENTS

| | | | |
|---|---|---|---|
| 619,671 | 2/1899 | Chapman et al. | 24/344 |
| 1,043,530 | 11/1912 | Millar | 248/126 |
| 1,227,906 | 5/1917 | Hayward | 24/344 |
| 1,251,443 | 12/1917 | Tatro | 24/344 |
| 2,063,924 | 12/1936 | Hanko | 362/396 |
| 2,638,297 | 5/1953 | Weinberger | 248/126 |
| 3,069,539 | 12/1962 | Kidd | 248/316.7 |
| 3,591,115 | 7/1971 | Hibbard | 248/126 |
| 3,596,859 | 8/1971 | MacDonald | 362/396 |
| 4,272,803 | 6/1981 | Johnson | 362/427 |
| 4,399,498 | 8/1983 | Bacevius | 362/396 |

FOREIGN PATENT DOCUMENTS

| | | | |
|---|---|---|---|
| 566593 | 4/1958 | Belgium | 248/316.7 |

*Primary Examiner*—Andrew M. Dolinar
*Attorney, Agent, or Firm*—Frank L. Zugelter

[57] ABSTRACT

A droplight tool accessory which produces a universality of position for the droplight, resulting in full intensity of illumination and reflection of light in the direction toward point of work. The accessory comprises three flexible arms between two of which an opening is provided and through which the droplight's handle is inserted so as to be clamped by lines of support included in the arms. Means to hand and rotate the accessory are included, as well as spaced points of support to seat the accessory and clamped droplight on a support surface.

16 Claims, 10 Drawing Figures

FIG. 4.
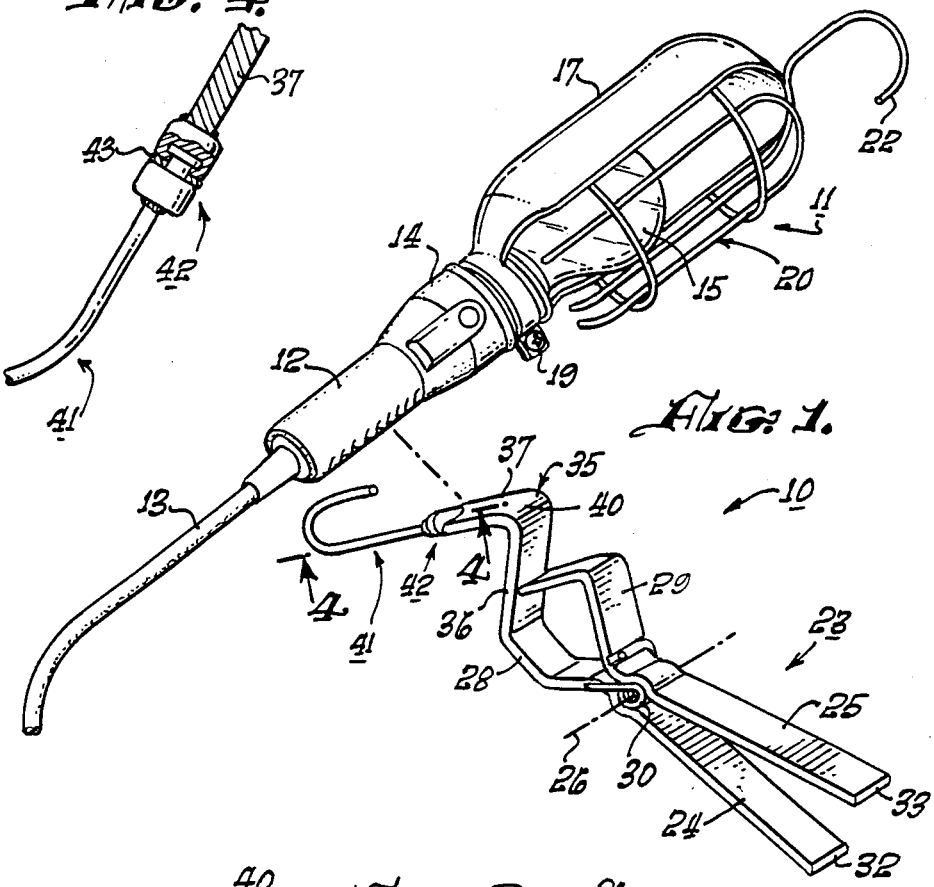
FIG. 1.
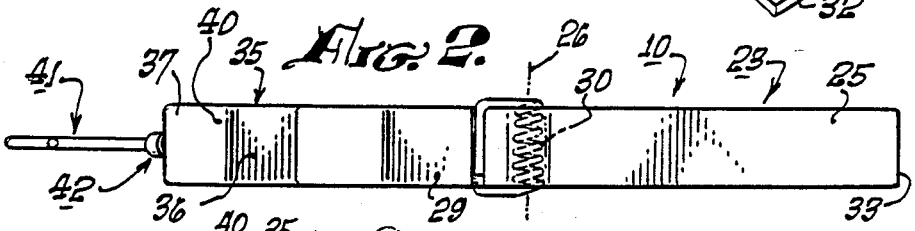
FIG. 2.
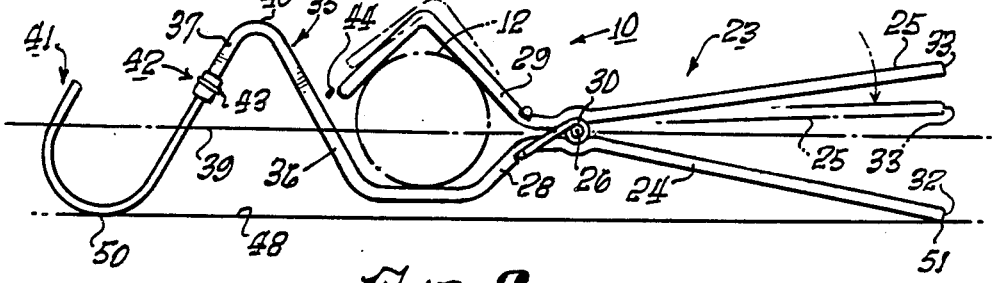
FIG. 3.

TOOL ACCESSORY

TECHNICAL FIELD

This invention is directed to a tool accessory and in particular, to a manufacture for maintaining direction of light to a point of work, such as, for example, in conjunction with use of a droplight.

BACKGROUND ART

See: U.S. Pat. Nos. 1,479,739; 1,669,747; 2,063,924; 2,602,880; 4,019,047; and 4,128,226.

DISCLOSURES OF THE INVENTION

A. Background

Droplights are state-of-the-art contraptions, and are usually hung by means of a hook swivally or not swivally mounted at the top of a reflector element of the droplight, or stationed in the vicinity of the point of work.

B. Problems in the Prior Art

The mere mounting of hook to droplight assembly has its disadvantages in actual use, the sum and substance of which is that the greatest intensity of illumination and reflection cast outwardly thereof never seems to get directly to the point of work. For one reason or another, such as, for example, the limited or non-accomodating space in which the droplight is disposed, on a frame or the like to which the droplight's hook is hung, the fullest intensity of light illumination and reflection never reaches the point of work, usually at arms' length, at hands or fingers of a mechanic working in a relative darkened area. No matter how the droplight is turned on its hook, or laid in a position from which reflected light also radiates towards the point of work, full illumination and reflection, as a practical matter, has never been effectively realized.

C. Advantages of This Invention

The utility of this invention provides full illumination and reflection to the point of work. Eye strain and stress is eliminated and work at arms' length is clearly visible to the mechanic for applying whatever manual manipulations tools and workpiece elements are required, all of which makes the work project easier to complete, with efficiency of time and effort on the part of the mechanic. With cost of labor relatively high in the repair marketplace, significant reduction in costs of repair to the owner of the workpiece (e.g., an automobile with engine under hood) can be achieved, while correspondingly, the mechanic is provided with additional time with which to increase frequency or repairs or other work and thereby increase profits. Also, the home mechanic can realize the healtful and time-saving benefits mentioned above.

D. Brief Summary of The Invention

The invention comprises a manufacture which grasps the handle of a droplight, and which nevertheless provides for rotatability of the droplight, and which further includes a feature which provides 360° rotation of the grasped droplight, thereby achieving a universality of position for the droplight. Such universality results in full intensity of illumination and reflection of light in the direction toward the point of work. In a first embodiment of the invention, a clip member clamps upon the droplight's handle which is first rotated to a desired position before such clamping. A hanging means, such as a hook, is frictionally and swivally mounted on a member extending in a generally longitudinal manner at the forward or clamping end of the manufacture. With droplight clamped in the clip member, with reflector functioning in a generally desired direction, the hook is mounted to a wire support or the like, and clip member and droplight are swivalled to the exact degree at which full illumination and reflection on the point of work is acquired. This embodiment is capable also of use without the swival feature of the hook functioning, but nevertheless using the hook as a support member. A point of support on the hanging means or hook along with a point of support at the rear of the clip member provides the necessary support for a clamped droplight mounted or seated on a supporting surface, such as a workbench, engine block, etc.

A second embodiment of the invention includes both the hanging and clamping features, and is manifested in a one-piece flexible three-armed manufacture. An opening is provided for the purpose of obtaining a clamped condition on a droplight's handle by flexing two of the arms the ends of which form the opening. This embodiment also is capable of utilizing spaced points of support by which it mounts or seats on a support surface rather than be hung by the hanging means.

E. Objects of This Invention

An object of this invention is to provide a novel or improved implement for grasping a droplight to achieve maximum intensity of illumination and reflection in use of the droplight.

Another object of this invention is to provide a universality of position for a droplight.

Another object of the invention is to provide reduction in eye strain and stress in one's person laboring to conclude work at a point of work.

A further object of this invention is to provide a product readily and easily accomodating to a mechanic at his workstation for achieving conclusion of work at a point of work, in terms of efficiency of time and effort.

A still further object of this invention is to provide an inexpensive manufacture.

These and other objects and advantages will become more apparent upon a full and complete reading of the following description, appended claims thereto, and drawing comprising two (2) sheets.

BRIEF DESCRIPTION OF THE DRAWING

FIG. 1 is a perspective view of an embodiment of the invention in a preparatory relationship of use with or on a conventional droplight.

FIG. 2 is an edge view of the embodiment of FIG. 1.

FIG. 3 is an elevational view of the embodiment of FIG. 1.

FIG. 4 is a view taken on line 4—4 of FIG. 1.

DESCRIPTION OF THE PREFERRED EMBODIMENT

Figure 5:
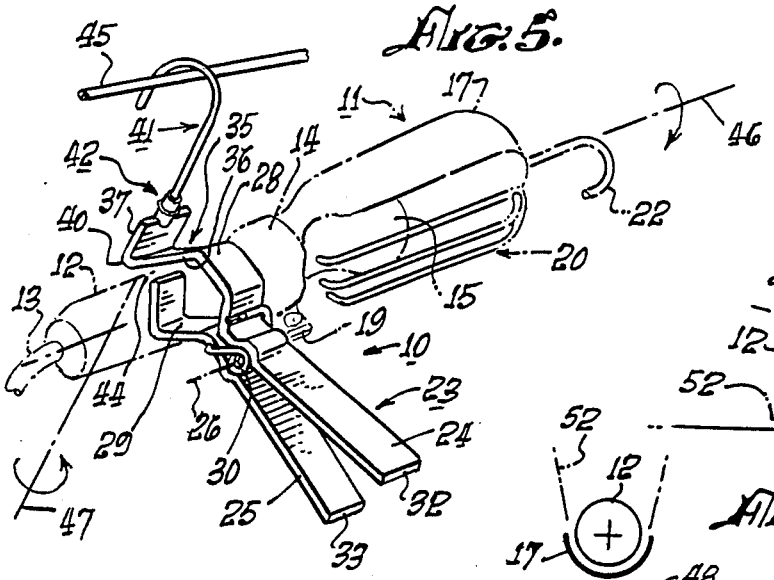
FIG. 5 is a perspective view of the embodiment of FIG. 1 as applied to a conventional droplight.

Referring now to the drawing wherein reference characters correspond to like numerals hereinafter, an embodiment 10, FIG. 1, is shown in preparatory position to its attachment to a conventional droplight 11. Droplight 11 includes a handle 12 attached to electrical wiring insulation 13, a socket 14 formed in handle 12 for connection with an incandescent lamp bulb 15, a reflector or reflecting member 17 for redirecting a portion of light emitted from bulb 15, the member 17 clamped in usual fashion as at 19 to socket 14, a wire cage 20 suitably hinged to and to open away from reflecting member 17 for access to bulb 15, and a hook 22 (formed with cage 20) for hanging droplight 10 in a work location. It is to this droplight 11 that the instant invention is attached. Embodiment or holder 10 comprises a clip member 23 having a pair of levers 24, 25 joined together at a fulcrum 26 so that a pair of jaws 28, 29 respectively corresponding to levers 24, 25 open away from and close towards one another as levers 24, 25 operate with respect to one another. Jaws 28, 29 provide the means to apply, i.e., clamp holder 10 to handle 12 of droplight 11. To so clamp holder 10 to droplight 11, levers 24, 25 are biased by an appropriate suitable spring 30, FIGS. 1, 1*a*, mounted at the juncture or fulcrum 26 of levers 24, 25 and jaws 28, 29 in a manner, for example, as utilized in a conventional clothes pin arrangement. The natural action of spring 30 maintains ends 32, 33 of the levers open while jaws 28, 29 remain or tend to remain in a closed condition, FIG. 1, unless the levers are operated to open the jaws.

An extension member 35 is securely mounted at the one end of jaw 28, and comprises a first leg 36 and a second leg 37. Leg 36 extends obliquely in relation to a longitudinal axis 39 for holder 10, FIG. 3, and generally within the confines of the widths of levers 24, 25 and jaws 28, 29, and preferably configured in a uni-directional fashion. Leg 37 is fastened, as at 40, to leg 36, preferably integrally made therewith, and is disposed in an angular relationship to leg 37. A hanging means (hook) 41 is swivally mounted, at 42, on the end of leg 37, FIGS. 1, 3, 4. Swival 42 includes a member 43, such as a friction washer, to maintain means 41 and leg 37, to provide a stationary position for the entire article.

In operation, FIGS. 3, 5, levers 24, 25 are manually pushed together, against the bias of spring 30, opening further jaws 28, 29, the phantom arrow and phantom lines in FIG. 3 so illustrating. By such further opening of jaws 28, 29, at least an adequate space in the vicinity of 44, FIG. 3, develops so that the jaws can circumscribe or enclosed about handle 12. Clip member 23 is first positioned about insulation 13, then moved onto handle 12, in order for jaws 28, 29 to grasp and clamped upon it by the release of levers 24, 25. Hook 41 is seated upon a support element or device, such as for example, a wire or rod 45, located in the work area for the operator or mechanic. With jaws 28, 29 moved to an unclamped condition for handle 12, droplight 11 is rotated about its axis 46 until bulb and reflector are cast towards a plane in which work at hand is to be performed. Levers 24, 25 are released so that jaws 28, 29 clamp upon handle 12 to maintain such cast. Holder 10 is swivalled about means 42, i.e., rotated about its axis 47, FIG. 5, so that light from bulb and reflector strike the exact spot desired, viz., the work at hand. The built-in friction member 43 at swival means 42 maintains holder 10 in the direction for the light to be cast upon the exact spot.

Figure 6C:
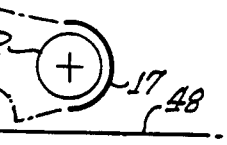
FIGS. 6*a*, 6*b*, and 6*c* are schematic views of manners of use of the embodiment of FIG. 1.
Figure 6B:
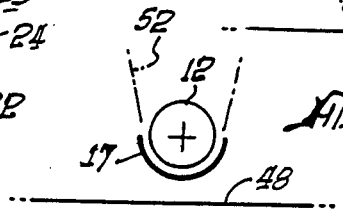
Figure 6A:
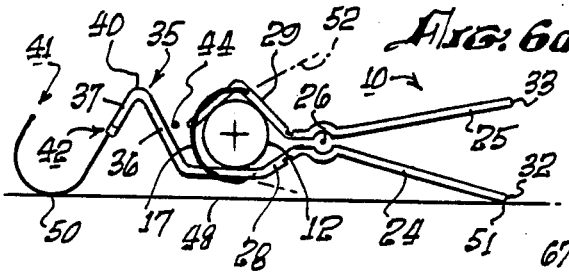

The schematics of FIGS. 6*a*, 6*b*, and 6*c*, with spring 30 omitted for clarity, illustrate situations of use for manufacture 10 with a droplight 11, where hooking means 41 does not mount them together on a rod 45 or the like. In particular, FIG. 6*a* shows holder 10 stationarily supported upon a surface 48, while being clamped upon a droplight whose illumination and reflection is directed towards levers 24, 25. Two primary points of support 50, 51 on hook 41 and lever 24 support holder 10 on surface 48 to maintain droplight 11 in a stationary position. Full illumination and reflection towards a point of work results. FIGS. 6*b* and 6*c* illustrate various changes of position for droplight 11 rotated to a different position in holder 10 which remains seated on surface 48, to still provide directions of full illumination and reflection to a desired point of work, such directions shown by the dash lines 52.

Figure 7:
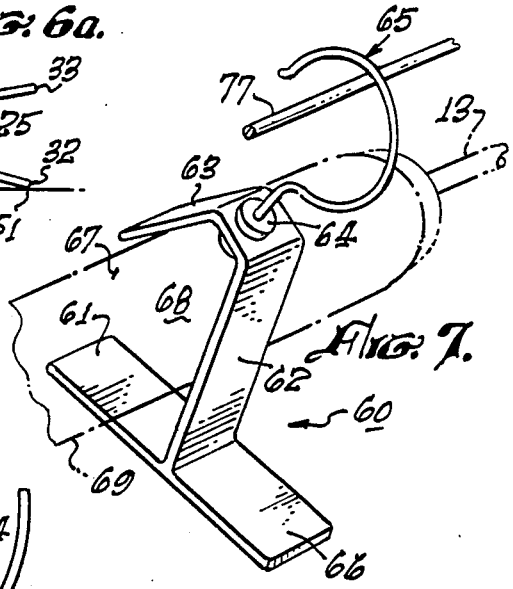
FIG. 7 is a perspective view of another embodiment of the invention as applied to a conventional droplight shown in phantom.
Figure 8:
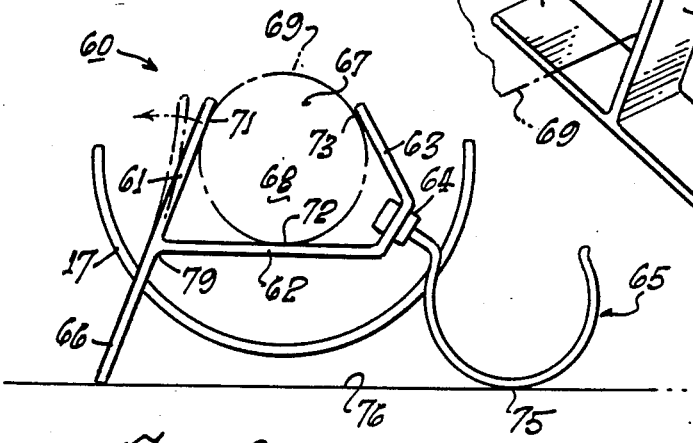
FIG. 8 is a side view of the embodiment of FIG. 7.

FIGS. 7 and 8 depict another embodiment 60 of the invention. Embodiment 60 comprises at least three stiff arms 61, 62, 63 operatively connected together to form an article of polygonal configuration, a frictionally-actuated mechanism or swival 64 mounted at a juncture of arms, here, between the two arms 62, 63, and a means 65 for hanging article 60 in a desired location mounted to feature 64. A foot 66 is attached to arm 61. Arms 61 and 63 are not physically joined together, so as to provide a substantial opening 67 which is maintained and which provides ingress and egress to an interior space 68 formed by the polygonal configuration for the manufacture. At least one of the arms 61, 63, and preferably both, include sufficient flexible characteristics by which one or both can be flexed or deflected away from the other and by which action interior space 68 enlarges sufficiently for clamping of a handle or the like 69 of a tool, such as a droplight or the like. Points of support 71, 72, 73 on arms 61, 62, 63 respectively, engage corresponding points on the periphery of handle 69 to clamp the tool to article 60.

Swival mechanism 64 may be similar to the one shown in FIG. 4, or may be one of other conventional construction, and is preferably secured at a juncture between arms 62, 63. Such securement is in such a location that no physical interference occurs with any surface point or line on the periphery of handle 69. A suitable hanging means such as hook 65, is attached thereto.

The material forming arms 61, 62, 63 is sufficiently flexible along their respective longitudinal axes which are coplanar, so that opening 67 enlarges, such as by arm 61 flexing outwardly, shown in phantom, FIG. 8, to a size greater than the diameter of handle 69. However, interior space 68 does not exceed the handle's diameter so as to have points or of support 71, 72, 73 clamp handle 69 at any rotational position for the handle within space 68. In this manner, full illumination and reflection is directed in any desired direction to a point of work.

FIG. 8 also illustrates a position of use for embodiment 60 wherein hanging means 65 constitutes a rest 75 or point of support as distinguished from its hanging function. Foot 66 functions to flex open arm 61 in addition to providing a support which with rest point 75, located along the length of hook 65, seat holder 60 on surface 76, while tool handle 69 is held in space 68 in a clamped manner for achieving full illumination and reflection in a desired direction. Reflector 17, FIGS. 8, 5 readily clears surface 76, FIG. 8 embodiment, by reason of the locations of foot 66 and point of support 75 in hanging means 65. FIG. 7 shows use of means 65 as a hook, hanging on a wire 77. Full illumination along a desired line of light is achieved by either rotating the handle within spacing 68 against the clamping effects of arms 61, 62, 63 or rotating such arms about swival means 64 to gain such line of light, or by a combination of both rotations.

Operation of this embodiment 60 is essentially the same as that of the first embodiment; by inserting insulation 13 through opening 67, and thereafter flexing arms 61, 63 openly to move the manufacture 60 up and onto handle 69 of a tool rotated to a desired degree, releasing flexed arms 61, 63, then swivalling tool and manufacture on swival means 64 to a desired position for casting illumination and reflection on an exact point of work.

Suitable materials, such as metal, wood or plastic may be utilized, the elements of the embodiment being fabricated therefrom in conventional manner. Embodiment 60 preferably is molded in one piece.

Various changes and modifications may be made without varying from the scope and spirit of the invention. The extension member 35 may or may not be integrally formed upon or with a one-piece element comprising lever 24 and jaw 28 of clip member 23. An angled flange (not shown) may be mounted at the tip or end of extension member 35 and on which a curve-like hanging element 41 can be bolted or riveted in frictional swivalled manner thereto, with a spring mounted on the bolt between element 41 and the tip to provide the desired friction for operation of the invention.

In the embodiment 60, three arms 61, 62, 63 are shown, FIG. 7. Use of more than three arms lies within the contemplation of the invention, as long as a sufficient number of points or lines of support clamp upon a handle to prevent it from loosely dangling within the space 68 of the polygonal configuration for the article and which would defeat the purpose of use of the invention. For example, fourth, fifth, and sixth arms could intervene respectively between the first and second arms, the second arm and the juncture at which means 64 is located, and such juncture and the third arm. Preferably, foot 66 is a straight extension of arm 61, although the angle foot 66 makes with arm 62, shown to be obtuse in FIG. 8, may be greater or may be made more acute than shown. Also, foot 66 may be eliminated, as long as point of contact 75 and a point of contact 79, FIG. 8, can function, i.e., without the diameter of the element forming reflector 17 interfering with such points of contact 75, 79 from properly seating on a mounting surface or the like. Thus, although reflector 17 also in FIG. 8 is shown off of floor 76, the invention contemplates reflector 17 to be able to rest on floor 76 thereby forming another point of contact with floor 76; just as long as the reflector does not interfere with the functioning of other points or lines of support in the arms for a handle 68 in embodiment 60. Further, this contemplation is readily adapted to embodiment 10, in its FIGS. *6a, 6b, 6c* uses, and in which jaw 28 can rest also on surface 48, but without interfering with the functions of points of support 50, 51.

I claim:

1. A manufacture for supporting a tool or the like comprising (1) no more or less than a first arm, a second arm and a third arm, each arm being stiff and all fixed together to configure an article having an interior space formed within all of said arms, said arms having lengths including lines of support along their corresponding lengths, (2) the first and third arms including corresponding ends forming a substantial opening maintained between them, one of the first and third arms at least flexible in the vicinity of such opening, so that upon disposition in such interior space of a handle for a tool or the like, all of said lines of support frictionally clamp upon such handle, (3) means for rotating the article mounted on the manufacture, and (4) hanging means mounted on said rotating means.

2. The manufacture of claim 1 including a positioning element as part of said rotating means.

3. The manufacture of claim 2 wherein said positioning element is a friction washer.

4. The manufacture of claim 1 or claim 2 or claim 3 including means for contact one of which is included in said hanging means.

5. The manufacture of claim 4 including a foot extending from the juncture of said first arm and said second arm, said foot including another means of contact.

6. The manufacture of claim 1 or claim 2 or claim 3 including a foot extending from the juncture of said first arm and said second arm, said foot including another means of contact.

7. The manufacture of claim 1 or claim 2 wherein said rotating means is mounted between the second arm and the third arm.

8. The manufacture of claim 1 or claim 2 wherein said rotating means is mounted at a juncture joining together the second arm and the third arm.

9. In a manufacture of supporting the handle of a tool or the like, the improvement comprising (1) no more or less than a first arm, a second arm and a third arm, each arm being stiff and all fixed together to configure an article having an interior space formed within all of said arms, said arms having lengths including lines of support along their corresponding lengths, (2) the first and third arms including corresponding ends forming a substantial opening maintained between them, one of the first and third arms at least flexible in the vicinity of such opening, so that upon disposition in such interior space of handle for a tool or the like, all of such lines of support frictionally clamp upon such handle, (3) means for rotating the article mounted on the manufacture, and (4) hanging means mounted on said rotating means.

10. The improvement of claim 9 including a positioning element as part of said rotating means.

11. The improvement of claim 10 where said positioning element is a friction washer.

12. The improvement of claim 9 or claim 10 or claim 11 including means for contact one of which is included in said hanging means.

13. The improvement of claim 12 including a foot extending from the juncture of said first arm and said second arm, said foot including another means of contact.

14. The improvement of claim 9 or claim 10 or claim 11 including a foot extending from the juncture of said first arm and said second arm, said foot including another means of contact.

15. The improvement of claim 9 or claim 10 wherein said rotating means is mounted between the second arm and the third arm.

16. The improvement of claim 9 or claim 10 wherein said rotating means is mounted at a juncture joining together the second arm and the third arm.

* * * * *